US007238753B2

(12) United States Patent
Yamaguchi et al.

(10) Patent No.: US 7,238,753 B2
(45) Date of Patent: Jul. 3, 2007

(54) CARPET, STAINPROOFING AGENT FOR CARPET AND METHOD FOR TREATING THE CARPET

(75) Inventors: Fumihiko Yamaguchi, Settsu (JP); Masamichi Morita, Settsu (JP); Yasushi Nakamae, Settsu (JP); Hiroko Yano, Settsu (JP); Kazuyuki Satoh, Settsu (JP); Masato Ioki, Settsu (JP)

(73) Assignee: Daikin Industries, Ltd., Osaka-shi (JP)

( * ) Notice: Subject to any disclaimer, the term of this patent is extended or adjusted under 35 U.S.C. 154(b) by 0 days.

(21) Appl. No.: 10/919,428

(22) Filed: Aug. 17, 2004

(65) Prior Publication Data

US 2005/0019523 A1 Jan. 27, 2005

Related U.S. Application Data

(62) Division of application No. 09/368,429, filed on Aug. 5, 1999, now Pat. No. 6,794,010.

(30) Foreign Application Priority Data

Aug. 18, 1998 (JP) ..... 10-232084
Apr. 20, 1999 (JP) ..... 11-111737

(51) Int. Cl.
*C08F 8/30* (2006.01)

(52) U.S. Cl. ..... 525/374; 524/544; 524/545; 524/546; 525/326.3; 525/375

(58) Field of Classification Search ..... 525/326.3, 525/374, 375; 524/544, 545, 546
See application file for complete search history.

(56) References Cited

U.S. PATENT DOCUMENTS 3,594,353 A 7/1971 Domba
3,819,772 A 6/1974 Kolobow
4,592,940 A 6/1986 Blyth et al.
4,636,331 A 1/1987 Sako et al.
4,835,300 A 5/1989 Fukui et al.
4,868,042 A 9/1989 Adiletta
5,143,991 A 9/1992 Amimoto et al.
5,316,850 A 5/1994 Sargent et al.
5,349,003 A 9/1994 Kato et al.
5,614,123 A 3/1997 Kubo et al.
5,630,846 A 5/1997 Hara et al.
5,830,963 A 11/1998 Kubo et al.
5,843,328 A 12/1998 Pacifici et al.
5,883,175 A 3/1999 Kubo et al.

OTHER PUBLICATIONS

English language translation of the Abstract for JP 59-150175A, Aug. 28, 1984.

*Primary Examiner*—Bernard Lipman
(74) *Attorney, Agent, or Firm*—Birch, Stewart, Kolasch & Birch, LLP

(57) ABSTRACT

The invention relates to a carpet comprising a stainproof-treated textile, wherein the carpet has stainproof ratio (%) of at least 30% as defined below:

$$\text{Stainproof ratio (\%)}=100\times(\Delta E_N \Delta E_{Tn})/\Delta E_N$$

$\Delta E_N$: Color difference after stainproof test of untreated carpet;

$\Delta E_{Tn}$: Color difference after stainproof test of carpet treated by the stainproof agent;

n: the number of cleaning; cleaning is conducted according to AATCC-138, $n \leqq 20$.

4 Claims, No Drawings

CARPET, STAINPROOFING AGENT FOR CARPET AND METHOD FOR TREATING THE CARPET

This application is a Divisional of application Ser. No. 09/368,429, filed on Aug. 5, 1999, now U.S. Pat. No. 6,794,010 and for which priority is claimed under 35 U.S.C. § 120; and this application claims priority of Application No. 232084/1998 filed in Japan on Aug. 18, 1998 and Application No. 111737/1999 filed in Japan on Apr. 20, 1999 under 35 U.S.C. § 119; the entire contents of all are hereby incorporated by reference.

FIELD OF THE INVENTION

The invention relates to a stainproofing agent for carpet, a method for stainproofing a carpet and stainproof-treated carpet.

BACKGROUND ART

A variety of stainproofing agents are proposed to impart water-repellency, oil-repellency and stainproof properties to textile (eg. carpet).

Japanese Examined Patent Publication No. 8606/1973 discloses that stainproof properties are imparted by treating fibers with a homopolymer obtained by polymerizing an ester of an unsaturated carboxylic acid having a perfluoroalkyl group at both ends. However, this homopolymer is insufficient in stainproof properties.

Japanese Examined Patent Publication No. 3767/1976 discloses that stainproof properties are imparted to fibers by treating the fibers with a polymer obtained by polymerizing (i) an ester of maleic or fumaric acid having a perfluoroalkyl group at one end and an aliphatic or aromatic group having no fluorine atom at the other end with (ii) the other polymerizable unsaturated compound. Since one end of the ester of maleic or fumaric acid has no fluorine atom, its polymerizablity is good. However, this polymer is insufficient in water- and oil-repellency and is also insufficient in stainproof properties.

U.S. Pat. No. 3,594,353 discloses that a water repellency and stainproof properties to oil are imparted to fibers by treating the fibers with a polymer obtained by homopolymerizing an ester of itaconic acid having a perfluoroalkyl group at both ends or one end or copolymerizing said ester with the other polymerizable unsaturated compound. However, this polymer is insufficient in water- and oil-repellency and stainproof properties.

None of stainproofing agents which have hitherto been proposed presently has sufficient water- and oil-repellency, stainproof properties and also cleaning durability. Although a carpet treated by a conventional method to impart water-repellency, oil-repellency and stainproof properties thereto is better than untreated carpet in initial water-repellency, oil-repellency and stainproof properties, the properties are insufficient, and cleaning durability of the carpet is also insufficient.

It is an object of the invention to provide a carpet with excellent initial water-repellency and stainproof properties and also outstanding cleaning durability, a stainproofing agent for carpet, a method for stainproof treatment of carpet.

DISCLOSURE OF THE INVENTION

The inventors conducted extensive research to solve such problems and found that excellent water-repellency, stainproof properties and cleaning durability may be imparted to a carpet by treating the carpet with a stainproofing agent and a specific crosslinking agent, thus the invention has been accomplished.

Thus, the invention relates to a carpet to which stainproof properties and cleaning durability are imparted by treating the carpet with (i) a fluoroalkyl-containing compound and (ii) a triazine ring-containing crosslinking agent, a stainproofing agent and a method for stainproof treatment of a carpet.

Stainproof degree of carpet of the invention maintains at least 30% after cleaning of 3 times, preferably 5 times, more preferably 10 times, further preferably 15 times, in particular 20 times.

The fluorine-containing stainproofing agent comprising a fluoroalkyl group (hereinafter referred to as "Rf") containing compound is not specifically limited to, but includes known compounds.

Examples of the fluorine-containing stainproofing agent comprising Rf group-containing compound are:

UNIDYNE TG-3010, TG-3020, TG-3040, TG-3510, TG-3520, TG-3710, TG-3720, TG-3711, TG-452, TG-452A, TG-930, TG-232 (DAIKIN Industries Ltd.);

SCOTCHGUARD FX-1367F, FX-1373M, FX-1355, FC-393, FC-367, FC-369, FC-398, FC-399 (Minnesota Mining and Manufacturing Co.);

ZONYL FCC, 8779, AFC, NRD-372, N-140, N-119 (E.I. du Pont de Nemours and Company);

ASAHIGUARD AG-820, AG-850, AG-923 (ASAHI GLASS CO., LTD.);

NUVA-FT, FTA (HOECHST AG); and

CRS-7 (NIKKA KAGAKU).

Specifically, the fluorine-containing stainproofing agent includes fluoroalkyl-containing maleic acid diester copolymer, fluoroalkyl-containing adipic acid diester compound and fluoroalkyl-containing urethane compound as shown below.

(1) Fluoroalkyl-Containing Maleic Acid Diester Copolymer

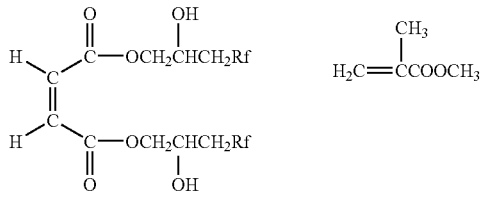

(15 mol) (75 mol)

(2) Fluoroalkyl-Containing Adipic Acid Diester Compound

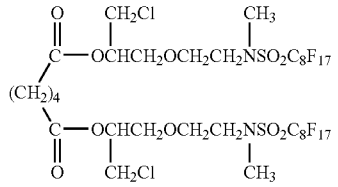

(3) Fluoroalkyl-Containing Urethane Compound

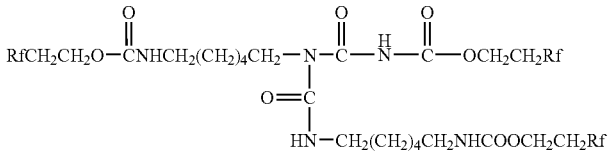

wherein Rf represents $C_nF_{2n+1}$ (n is an integer of 5 to 21).

The amount of fluorine atom in solid content of stainproofing agent preferably ranges from 50 to 10,000 ppm based on the unit weight of carpet pile. Less than 50 ppm of the amount of fluorine atom results in insufficient stainproof properties. More than 10,000 of the amount of fluorine atom does not greatly improve stainproof properties.

The triazine ring-containing compound of the invention represented by formula (1) improves an adhesion property between said fluorine-containing stainproofing agent comprising Rf-containing compound and carpet pile, and also hardens coating:

(1)

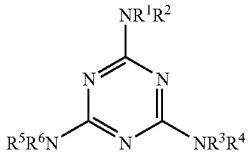

wherein $R^1$ to $R^6$ are the same or different, and represent —H, —OH, —$CH_2OCH_3$, —$CH_2OH$, —$CH_2CH_2OH$, —$CH_2CH_2CH_2OH$, or —$CH_2OC_2H_5$, preferably —$CH_2OH$.

As crosslinking agent represented by formula (1), trimethylolmelamine and hexamethylolmelamine are particularly preferable. Example of commercial name of the crosslinking agent is SUMITEX RESIN M-3 (trimethylolmelamine; SUMITOMO CHEMICAL Co. LTD.).

Coating mass of the triazine ring-containing compound preferably ranges from 0.01 to 1.0% by weight based on the unit weight of carpet. When coating mass is less than 0.01% by weight, cleaning durability is insufficient. When coating mass is more than 1.0% by weight, cleaning durability is not improved but results in hard feeling, thereby not preferable.

Catalyst is preferably added to the triazine ring-containing compound to accelerate a reaction. Examples of catalyst are formic acid, acetic acid and like organic carboxylic acids; organic carboxylates between the organic carboxylic acids and ammonium, sodium, potassium, etc.; sulfuric acid, persulfuric acid, hydrochloric acid, phosphoric acid, nitric acid and like inorganic acids; inorganic acid salts between the inorganic acids and ammonium, sodium, potassium, magnesium, zinc, aluminum, iron, etc. The amount of catalyst is not specifically limited to, but usually 5–100% by weight based on the amount of triazine ring-containing compound.

The stainproofing agent for carpet may be in the form of aqueous dispersion or solution in a solvent.

The stainproofing agent of the present invention can be applied by any method according to the kind of the material to be treated. For example, there can be used a method for applying the agent of the invention on the surface of material to be treated, using a known application procedure such as immersion, coating, etc., followed by drying. Furthermore, the stainproofing agent of the present invention may further comprise additives and a crosslinking agent other than said crosslinking agent. For example, polymethyl methacrylate/ethyl methacrylate (P-MMA/EMA) and like polymer, additives such as insect repellents, flame retardants, antistatic agents, dye fixing agents, wrinkle inhibitors, softeners and stain block agents which inhibit adhesion of acid dye may be appropriately added.

The material to be treated with the stainproofing agent of the present invention is preferably a textile, in particular, a carpet. Examples of the textile are animal-origin natural fibers such as cotton, hemp, wool, silk, etc.; synthetic fibers such as polyamide (nylon), polyester, polyvinyl alcohol, polyacrylonitrile, polyvinyl chloride, polypropylene, etc.; semisynthetic fibers such as rayon, cellulose acetate, etc.; inorganic fibers such as glass fibers, carbon fibers, asbestos fibers, etc.; and a mixture of these fibers. Preferable fibers are polyamide (nylon), polyester, polyvinyl alcohol, polyacrylonitrile, polyvinyl chloride, polypropylene and like synthetic fibers, rayon, cellulose acetate and like semisynthetic fibers or a mixture thereof. The textile may be in any form such as a fiber, a yarn, a cloth and the like. When a carpet is treated with the stainproofing agent of the present invention, the carpet may be formed after treating fibers or yarns with the stainproofing agent. Alternatively, the formed carpet may be treated with the stainproofing agent.

The carpet of the invention may be pre-treated with stain block agent before stainproof treatment. Examples of stain block agent are generally a poly(meth)acrylic acid and a sulphonic acid-containing phenol/formaldehyde condensation product, specifically FX-668F (Minnesota Mining and Manufacturing Co.), SR-300 (E.I. du Pont de Nemours and Company). The stain block agent is preferably used in a sufficient amount which allow 0.05–10% by weight of active ingredient based on the weight of carpet to be adhered on carpet. Stain block agent may be applied according to a usual treatment process such as hot air treatment, steam treatment, boiled water treatment, etc.

The stainproofing agent of the invention may further comprises PEG and/or a copolymer comprising (1) at least one selected from polyoxyethylene chain-containing acrylate and methacrylate; and (2) at least one reactive monomer selected from glycerol methacrylate and glycidyl methacrylate).

The copolymer or PEG may be used in an amount of 1–50% by weight, preferably 2–20% by weight based on the solid content of repellant.

Color of carpet to be treated includes blue.

With respect to color of carpet,

L=40 to 80, preferably L=40 to 60;

a=+0.1 to −0.8, preferably a=−0.1 to −0.6;

b=−13 to −25, preferably b=−17 to −21.

The carpet of the invention maintains a stainproof degree during resoiling of at least 20%, preferably at least 30% after one cycle of contamination, cleaning and recontamination.

BEST MODE FOR CARRYING OUT THE INVENTION

The invention is described below in detail by way of example. However, the invention is in no way limited to the examples.

Evaluation procedures of water-repellency, oil-repellency and stainproof property, cleaning process are shown below.

<Water-Repellency>

Five drops of isopropanol/water mixture having the following composition are slowly placed on the surface of carpet textile. Water repellency is represented by a maximum score at which at least 4 drops maintain a liquid form (repellent) after 3 minutes.

TABLE 1

| Score | Composition (% by volume) Isopropanol | Water |
|---|---|---|
| 0 | 0 | 100 |
| 2 | 2 | 98 |
| 5 | 5 | 95 |
| 10 | 10 | 90 |
| 15 | 15 | 85 |
| 20 | 20 | 80 |
| 25 | 25 | 75 |
| 30 | 30 | 70 |
| 40 | 40 | 60 |
| 50 | 50 | 50 |

<Oil-Repellency>

According to AATCC-TM-118-1966, five drops of the following test solution are slowly placed on the surface of carpet. Penetration state of the drops are observed after 3 minutes. Oil-repellency is represented by a maximum score at which at least 4 drops show no penetration into carpet.

TABLE 2

| Score | Test solution | Surface tension (mN/m: 25° C.) |
|---|---|---|
| 0 | Inferior to 1 | |
| 1 | Nujol | 31.2 |
| 2 | A mixture of N-hexadecane (35 parts by weight) and Nujol (65 parts by weight) | 29.6 |
| 3 | n-hexadecane | 27.3 |
| 4 | n-tetradecane | 26.7 |

<Stainproof Property Test 1>

Carpet treated with a stainproofing agent is evaluated according to AATCC-123-1995.

Carpet textile is cut into a 5.5 cm×8 cm test piece. The test piece is allowed to stand in thermohygrostat (21° C., 65% RH) for 4 hours, dried sufficiently, followed by contaminated with a dry soil having the following composition. Specifically, five carpet test pieces are attached to a ball mill in such a manner that the stainproof surface of the carpet is in a upward direction. 0.031 g of dry soil per 1 $cm^2$ surface area of the carpet test piece (corresponding to 6.82 g in case of five carpet test pieces) and 50 ceramic balls (2.0 cm in diameter) are put in the ball mill. The ball mill is then rotated at 80 rpm for 7.5 minutes to give the carpet test piece on the surface of which the dry soil is uniformly adhered. The ball mill has a tubular shape, and a base inner diameter of 12.0 cm and a height of 9.5 cm. The excessive dry soil on the carpet test piece is throughly removed by aspiration with domestic vacuum cleaner. Color difference (E) on the surface of carpet is determined with color difference meter (MINOLTA CR-310). Stainproof ratio (%) is calculated on the basis of the following equation.

Stainproof ratio (%)=$100\times(\Delta E_N \Delta E_{Tn})/\Delta E_N \Delta E_N$: Color difference after stainproof test of untreated carpet ΔETn: Color difference after stainproof test of carpet treated by the stainproofing agent n: the number of cleaning Dry soil composition, L, a and b values are shown below:

| Composition | Content (% by weight) |
|---|---|
| Peat moss | 38.4 |
| Cement | 18 |
| Kaoline | 18 |
| Silica | 18 |
| Carbon black | 1.15 |
| Iron oxide | 0.3 |
| Nujol | 6.25 |

with respect to Lab values, L: 25–31, a: 2.3–2.6, b: 4.2–4.8.

<Stainproof Property Test 2>

<Stainproof property test 2> is evaluated in the same manner as <Stainproof property test 1> except that the size of carpet textile is 11 cm×8 cm; and that the amount of dry soil per 1 $cm^2$ surface area of the carpet test piece is 0.0062 g (corresponding to 1.64 g in case of three carpet test pieces); and that rotation conditions are 80 rpm for 5 min.

<Cleaning Method>

Cleaning of the carpet textile treated with a stainproofing agent is conducted according to AATCC-138. Stated more specifically:

(i) the surface of carpet test piece (11 cm×11 cm) is washed with running water (50° C.) for 1 min, followed by squeezed with mangle (pressure: 5 mg/$cm^2$).

(ii) The carpet test piece is fixed and set on the testing stand of cleaning test machine (STAIN & CLEANING TESTER: YOSHIDA SEIKI SEISAKUSYO) as defined in JIS L1023-1992 in order that rotary brushes rub carpet piles.

(iii) Cleaning of the carpet is carried out by pouring 4.1 ml of 1% sodium lauryl sulfate (SLS) aqueous solution (adjusted at pH 8 with NaOH aqueous solution) warmed to 50° C. to carpet with pipette, followed by rotating rotary brush and testing stand.

One cleaning is composed of 5 rotations in regular direction, 5 rotations in reverse direction, further 5 rotations in regular direction and 5 rotations in reverse direction during which rotary brushes maintain rubbing carpet.

"Cleaning three times" mean that the process is repeated 3 times except that SLS 1% aqueous solution is not further added.

"Cleaning five times" means that the process is repeated 5 times except that SLS 1% aqueous solution is not added. The number of revolutions of the testing stand is 20 rpm. The number of rotation of brush is 240 rpm. Vacuum and water jet nozzle of cleaning test machine are not used.

The carpet is throughly rinsed with running water (50° C.), squeezed with mangle, and then dried in hot-air drying chamber at 105° C. for 30 min leading to completion of cleaning.

EXAMPLE 1

Nylon 6,6 carpet textile (cut pile, pile density: 40 oz/yd$^2$, pile height: ¼ inch, color: light blue) was dipped in water, squeezed with mangle to adjust wet pickup (the increased weight, represented by % by weight, of carpet after dipping in comparison with initial weight of carpet test piece) at 20% by weight.

A Stainproofing agent composition as shown in table 4 was prepared by mixing and stirring 8 parts by weight of UNIDYNE TG-3010 (Rf group-containing stainproofing agent for carpet; DAIKIN INDUSTRIES LTD.), 1.9 parts by weight of SUMITECH RESIN M-3 (trimethylolmelamine: SUMITOMO CHEMICAL CO., LTD.), 0.6 part by weight of SUMITECH ACCELERATOR (ACX; catalyst for SUMITECH RESIN M-3 which is a product of SUMITOMO CHEMICAL CO., LTD.) and 89.5 parts by weight of water. The carpet test piece (20 g) was treated with the stainproofing agent composition (1.5 g; corresponding to 400 ppm fluorine atom per 1 g of carpet), followed by heat-treated with pin stenter at 130° C. for 10 min.

The carpet test piece was cleaned (1 time, 3 times, 5 times) according to the above-defined method to evaluate water-repellency, oil-repellency and stainproof property before and after cleaning. The results are shown in table 6.

EXAMPLES 2–6

Stainproofing agent compositions as shown in table 4 were prepared. The carpet test piece was treated in the same manner as example 1.

The results are shown in table 6.

EXAMPLE 7

A stainproofing agent composition was prepared by diluting 6 parts by weight of emulsion (solid content 30% by weight) comprising Rf-maleate/methylmethacrylate (MMA) =60/40 (weight ratio) copolymer, SUMITEX RESIN M-3 and SUMITEX ACCELERATOR (ACX) with 94 parts by weight of water. The carpet test piece was treated with the stainproofing agent composition thus obtained in the same manner as example 1.

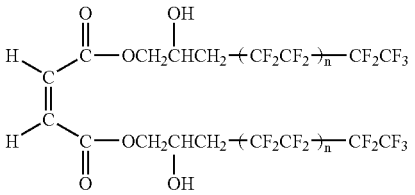

Rf maleate

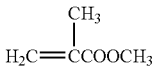

MMA wherein n is an integer of 3 to 8.

EXAMPLES 8–10

The carpet test piece shown in example 1 was subjected to stain block processing. To a stain block agent (FX-668F: Minnesota Mining and Manufacturing Co.) diluted to 0.7% with water was added $MgSO_4$ (1%), and pH of the solution was adjusted at 2 with sulfamic acid. The carpet test piece was boiled in the solution for 5 minutes. The test piece was washed with running water to remove an excess stain block agent and dried at 130° C. The resulting carpet test piece was dipped in water, squeezed with mangle to adjust wet pickup thereof at 20%.

Stainproofing agents as shown in table 4 were prepared to treat the carpet test piece in the same manner as example 1. The results are shown in table 6.

A stain block agent is a treatment applied to a material in order to inhibit adhesion of acid dye in the process of stainproof processing of carpet.

COMPARATIVE EXAMPLES 1–4

Stainproofing agent mixtures shown in table 5 were prepared and used for treating the carpet test piece in the same manner as example 1. The results are shown in table 6.

TABLE 4

| EX. | Rf-containing Stainproofing Agent Kind/Amount (Wt. Part) | Crosslinking Agent Kind/Amount (Wt. Part) | Water (Wt. Part) | Other Additives Kind/Amount (Wt. Part) |
|---|---|---|---|---|
| 1 | UNIDYNE TG3010/8 | SUMITEX RESIN M-3/1.8 | 89.5 | ACX (0.6) |
| 2 | UNIDYNE TG3010/8 | SUMITEX RESIN M-3/0.9 | 89.8 | ACX (0.3) |
| 3 | Rf-maleate-MMA Copolymer 30% | SUMITEX RESIN M-3/0.9 | 93.8 | ACX (0.3) |
| 4 | SCOT GUARD FX-1373M/5 | SUMITEX RESIN M-3/0.9 | 93.8 | ACX (0.3) |
| 5 | SCOT GUARD FX-1367F/8 | SUMITEX RESIN M-3/2.1 | 89.2 | ACX (0.7) |
| 6 | N-140/5 | SUMITEX RESIN M-3/1.5 | 93 | ACX (0.5) |
| 8 | UNIDYNE TG3010/8 | SUMITEX RESIN M-3/1.8 | 89.8 | ACX (0.3) |
| 9 | Rf-maleate-MMA Copolymer 30% Emulsion/5 | SUMITEX RESIN M-3/0.9 | 93.8 | ACX (0.3) |
| 10 | SCOT GUARD FX-1367F/8 | SUMITEX RESIN M-3/2.1 | 89.2 | ACX (0.7) |

TABLE 5

| Comp. Ex. | Rf-containing Stainproofing Agent Kind/Amount (Wt. Part) | Crosslinking Agent Kind/Amount (Wt. Part) | Water (Wt. part) | Other Additives Kind/Amount (Wt. Part) |
|---|---|---|---|---|
| 1 | UNIDYNE TG3010/8 | -/- | 89.5 | — |
| 2 | Rf-maleate-MMA Copolymer 30% Emulsion/5 | -/- | 89.8 | — |
| 3 | Rf-maleate-MMA Copolymer 30% Emulsion/5 | ELASTRON BN-69/1.5 | 93.35 | Cat64(0.15) |
| 4 | SCOT GUARD FX-1367F/5 | -/- | 93.8 | — |

TABLE 6

| Number of | Water-Repellency (Score) | | | | Oil-Repellency (Score) | | | | Stainproof Ratio (%) | | | |
|---|---|---|---|---|---|---|---|---|---|---|---|---|
| Cleaning | 0 | 1 | 3 | 5 | 0 | 1 | 3 | 5 | 0 | 1 | 3 | 5 |
| Example 1 | 20 | 15 | 15 | 15 | 0 | 0 | 0 | 0 | 41 | 39 | 37 | 35 |
| Example 2 | 20 | 15 | 10 | 10 | 0 | 0 | 0 | 0 | 41 | 38 | 35 | 33 |
| Example 3 | 20 | 20 | 15 | 15 | 0 | 0 | 0 | 0 | 42 | 40 | 38 | 35 |
| Example 4 | 20 | 20 | 15 | 15 | 0 | 0 | 0 | 0 | 40 | 39 | 38 | 36 |
| Example 5 | 25 | 25 | 25 | 20 | 1 | 1 | 1 | 1 | 50 | 49 | 47 | 43 |
| Example 6 | 25 | 20 | 20 | 15 | 0 | 0 | 0 | 0 | 52 | 50 | 48 | 45 |
| Example 7 | 20 | 15 | 15 | 10 | 0 | 0 | 0 | 0 | 40 | 38 | 37 | 32 |

TABLE 6-continued

| Number of | Water-Repellency (Score) | | | | Oil-Repellency (Score) | | | | Stainproof Ratio (%) | | | |
|---|---|---|---|---|---|---|---|---|---|---|---|---|
| Cleaning | 0 | 1 | 3 | 5 | 0 | 1 | 3 | 5 | 0 | 1 | 3 | 5 |
| Example 8 | 25 | 15 | 15 | 10 | 0 | 0 | 0 | 0 | 55 | 54 | 51 | 49 |
| Example 9 | 30 | 25 | 20 | 20 | 0 | 0 | 0 | 0 | 55 | 55 | 54 | 54 |
| Example 10 | 30 | 25 | 20 | 20 | 1 | 1 | 1 | 1 | 55 | 55 | 54 | 54 |
| Comp. Ex. 1 | 20 | 0 | X | X | 0 | 0 | 0 | 0 | 43 | 28 | 18 | 15 |
| Comp. Ex. 2 | 20 | 15 | 0 | 0 | 0 | 0 | 0 | 0 | 41 | 27 | 21 | 18 |
| Comp. Ex. 3 | 20 | 15 | 5 | 5 | 0 | 0 | 0 | 0 | 27 | 26 | 25 | 24 |
| Comp. Ex. 4 | 10 | 5 | X | X | 1 | 1 | 1 | 0 | 33 | 28 | 22 | 15 |

In table 3, the number of cleaning "0" means before cleaning.

With respect to stainproof ratio, carpet which is not treated with a stainproofing agent has a stainproof ratio of 100% before contamination and 0% after contamination.

EXAMPLE 11

Stain block processing was carried out in advance in the same manner as examples 8–10.

A stainproofing agent composition was prepared by mixing 8 parts by weight of TG-3010, 0.9 part by weight of SUMITEX RESIN M-3, 0.3 part by weight of SUMITEX ACCELERATOR, 0.7 part by weight of polyethyleneglycolmethacrylate(PEGMA)/glycerol methacrylate(GMA) =70/30 (by weight ratio) copolymer and 90.1 parts by weight of water. The carpet test piece was treated by the composition in the same manner as example 1.

The test piece was subjected to a test cycle comprising <stainproof property 2>, cleaning and <stainproof property 2>. After the last <stainproof property 2> treatment, stainproof ratio of the test piece was determined. The results are shown in table 8.

COMPARATIVE EXAMPLE 5

Stain block processing was carried out in advance in the same manner as examples 8–10. A stainproofing agent composition as shown in table 7 was prepared. The carpet test piece was treated with the stainproofing agent composition in the same manner as example 1. The test piece was subjected to the evaluation test as shown in example 11. The results are shown in table 8.

TABLE 7

| | Rf-Containing Stain-Proofing Agent Kind/Amount (Wt. Part) | Cross-Linking Agent Kind/Amount (Wt. Part) | PEGMA/GMA Copolymer (Wt. Part) | Water (Wt. Part) | Other Additive Kind/Amount (Wt. Part) |
|---|---|---|---|---|---|
| Ex. 11 | UNIDYNE TG3919.7 | SUMITEX RESIN M-3/0.9 | 0.7 | 90.1 | ACX(0.3) |
| Comp. Ex. 5 | UNIDYNE TG3010/8 | —/— | —/— | 92 | —/— |

TABLE 8

| | Stainproof ratio (%) | |
|---|---|---|
| | Initial | Recontamination |
| Ex. 11 | 65 | 35 |
| Comp. Ex. 5 | 60 | 15 |

What is claimed is:

1. A carpet comprising a stainproof-treated textile, wherein the carpet has a stainproof ratio defined below of at least 30%:

$$\text{Stainproof ratio (\%)}=100\times(\Delta E_N\Delta E_{Tn})/\Delta E_N, \text{ wherein}$$

$\Delta E_N$ is the color difference after a stainproof test of untreated carpet;

$\Delta E_{Tn}$ is the color difference after a stainproof test of carpet treated by the stainproof agent; and n is the number of cleanings conducted according to AATCC-138 and $n \leqq 20$;

wherein the carpet is treated with a stainproofing agent composition for carpet consisting essentially of:

(1) a fluorine-containing stainproofing agent consisting essentially of a fluoroalkyl-containing compound; and (2) a triazine ring-containing crosslinking agent represented by formula (1)

(1)

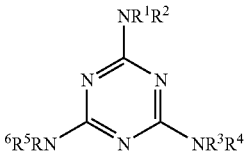

wherein R1 to R6 are the same or different and represent —H, —OH, —$CH_2OCH_3$, —$CH_2OH$, —$CH_2CH_2OH$, —$CH_2CH_2CH_2OH$, or $CH_2OC_2H_5$; and (3) at least one of a catalyst and an additive, wherein the catalyst is selected from the group consisting of organic carboxylic acids; organic carboxylates between the organic carboxylic acids and ammonium, sodium, or potassium; inorganic acids; inorganic acid salts between the inorganic acids and ammonium, sodium, potassium, magnesium, zinc, aluminum, or iron; and wherein the additive is selected from the group consisting of insect repellents, flame retardants, antistatic agents, dye fixing agents, wrinkle inhibitors, softeners and stain block agents which inhibit adhesion of acid dye, and the dry soil composition used in a stainproof test according to AATCC 123 is shown in the following table:

| Composition | Content (% by weight) |
|---|---|
| Peat moss | 38.4 |
| Cement | 18 |
| Kaoline | 18 |
| Silica | 18 |
| Carbon black | 1.15 |
| Iron oxide | 0.3 |
| Nujol | 6.25. |

2. A stainproofing agent composition for a carpet consisting essentially of:

a fluorine-containing stainproofing agent consisting essentially of a fluoroalkyl-containing compound; and a triazine ring-containing crosslinking agent represented by formula (1)

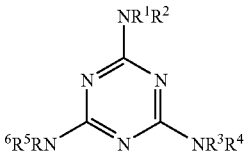

(1)

wherein R1 to R6 are the same or different and represent —H, —OH, —$CH_2OCH_3$, —$CH_2OH$, —$CH_2CH_2OH$, —$CH_2CH_2CH_2OH$, or $CH_2OC_2H_5$, and at least one of a catalyst and an additive, wherein the catalyst is selected from the group consisting of organic carboxylic acids; organic carboxylates between the organic carboxylic acids and ammonium, sodium, potassium; inorganic acids; inorganic acid salts between the inorganic acids and ammonium, sodium, potassium, magnesium, zinc, aluminum, and iron; and wherein the additive is selected from the group consisting of insect repellents, flame retardants, antistatic agents, dye fixing agents, wrinkle inhibitors, softeners and stain block agents which inhibit adhesion of acid dye.

3. The stainproofing agent composition according to claim 2, wherein the fluoroalkyl-containing compound has at least one member selected from the group consisting of fluoroalkyl-containing maleic acid diester copolymer, a fluoroalkyl-containing adipic acid diester compound and a fluoroalkyl-containing urethane compound.

4. The stainproofing agent composition according to claim 2, which consists essentially of a fluorine-containing stainproofing agent consisting essentially of a fluoroalkyl-containing compound and a triazine ring-containing crosslinking agent, and at least one of PEG and a copolymer consisting essentially of at least one monomer selected from the group consisting of an acrylate having a polyoxyethylene chain and a methacrylate having a polyoxyethylene chain; and at least one reactive monomer selected from the group consisting of gycerol methacrylate and glycidyl methacrylate.

* * * * *